United States Patent [19]

Eriksson

[11] Patent Number: 4,637,645

[45] Date of Patent: Jan. 20, 1987

[54] DEVICE FOR LIFTING AND HANDLING OBJECTS

[76] Inventor: Sven-Göran Eriksson, 8 Rymdvägen, S-981 44 Kiruna, Sweden

[21] Appl. No.: 744,813

[22] PCT Filed: Oct. 11, 1984

[86] PCT No.: PCT/SE84/00334

§ 371 Date: Jun. 13, 1985

§ 102(e) Date: Jun. 13, 1985

[87] PCT Pub. No.: WO85/01720

PCT Pub. Date: Apr. 25, 1985

[30] Foreign Application Priority Data

Oct. 13, 1983 [SE] Sweden ..... 83056366

[51] Int. Cl.[4] ..... B66C 1/42

[52] U.S. Cl. ..... 294/104; 294/110.1

[58] Field of Search ..... 294/62, 63.1, 103.2, 294/104, 106, 110.1, 110.2

[56] References Cited

U.S. PATENT DOCUMENTS

| | | | |
|---|---|---|---|
| 1,301,728 | 4/1919 | Milne | 294/106 |
| 2,403,346 | 7/1946 | Deiters | 294/110.1 X |
| 2,866,660 | 12/1958 | McGuire et al. | 294/104 X |
| 3,068,036 | 12/1962 | Doty | 294/104 |
| 3,186,752 | 6/1965 | Kaplan et al. | 294/104 |
| 3,207,548 | 9/1965 | Moskopf et al. | 294/104 |
| 3,273,931 | 9/1966 | Caldwell et al. | 294/106 |
| 3,479,078 | 11/1969 | Doty | 294/104 |
| 4,097,084 | 6/1978 | Russell | 294/110.1 X |
| 4,133,570 | 1/1979 | Hammink et al. | 294/110.1 |

FOREIGN PATENT DOCUMENTS

| | | | |
|---|---|---|---|
| 444721 | 12/1974 | U.S.S.R. | 294/104 |

*Primary Examiner*—Johnny D. Cherry

*Attorney, Agent, or Firm*—Cushman, Darby & Cushman

[57] ABSTRACT

A device for lifting and handling objects, including cylindrical objects includes a lifting arm having a substantially vertical clamp portion and a substantially horizontal actuating portion provided with a lifting hook, a yoke having a substantially vertical clamp portion having ends and a substantially horizontal portion, the clamp portion of the lifting arm being, between its ends, pivotally connected to a free end of the substantially horizontal portion of the yoke, clamping jaws mounted on the clamp portions of the lifting arm and the yoke for engagement with diametrically opposite sides of an object to be lifted, a locking mechanism for releasably locking the lifting arm to the yoke in open position and a device for releasing the locking mechanism in downward swinging movement of the actuating portion of the lifting arm to allow the closing of the clamping jaws in order to grip the object to be lifted, the lifting hook being arranged for free movement in a slot provided in the actuating portion of the lifting arm and being connected to one end of a link, the link having an opposite end portion pivotally connected to the yoke remote from that end thereof which is pivotally connected to the clamp portion of the lifting arm.

2 Claims, 6 Drawing Figures

DEVICE FOR LIFTING AND HANDLING OBJECTS

This invention relates to a device for lifting and handling objects, especially cylindrical ones, comprising a lifting arm provided with a lifting hook, which is pivotably attached to a yoke, oppositely directed clamping shoes being arranged on the lifting arm and on the yoke.

Devices for lifting different types of objects, e.g. bales, pipes, paper rolls, steel profiles, are previously known.

At such lifting devices using a clamping effect it is extremely important that said clamping effect will not start to work before the lifting device is positioned. Moreover, the clamping effect should preferably be released automatically or via remote control.

At a known device operating with clamping effect the clamping effect is released as the lifting hook is displaced laterally when the lifting device is positioned. This displacement can either take place from the driver's stand of the crane or by a direct manual actuation of the lifting hook.

If said displacement is to take place from the driver's stand of the crane a precision work is apparently concerned. If, on the other hand, manual displacement is to be used this seems to mean certain risks in respect of labour safety as the displacement of the lifting hook releases the locking mechanism of the pivoting of the lifting arm.

When lifting of an object is finished the locking mechanism is to be re-connected. One must then proceed in reversed manner to what has been described above.

It is the object of this invention to show a device of the type mentioned above, at which the release of the locking mechanism of the lifting arm takes place automatically or via remote control. Return to locking of the lifting arm at a finished lifting operation takes place quite automatically.

The object of the invention is realized in that a device of the kind mentioned above has been given the characteristic features defined in the appended claims.

An illustrative example of the invention will be described below with reference to the enclosed drawings, where FIG. 1 is a lateral view of the device of the invention in a position to engage the object to be lifted;

Figure 2:
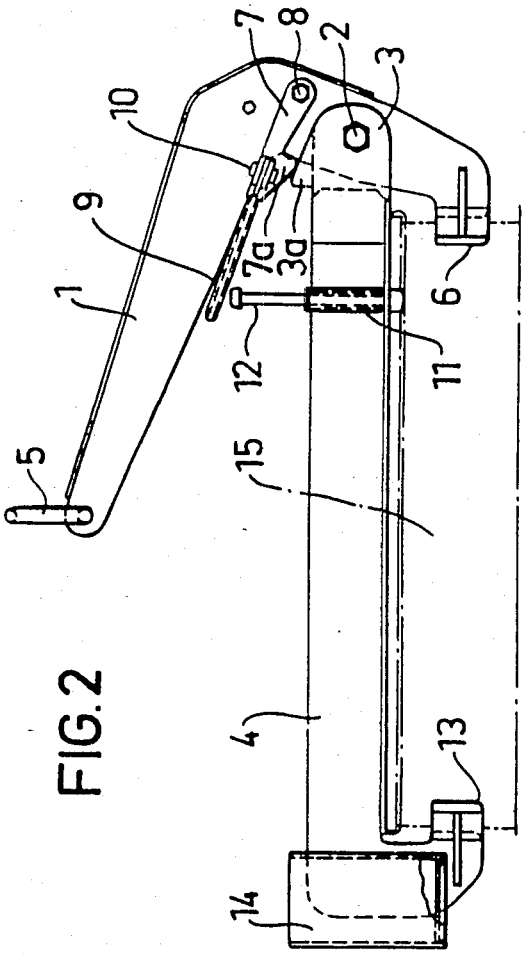
FIG. 2 shows the device according to FIG. 1 in lifting position.
Figure 1:
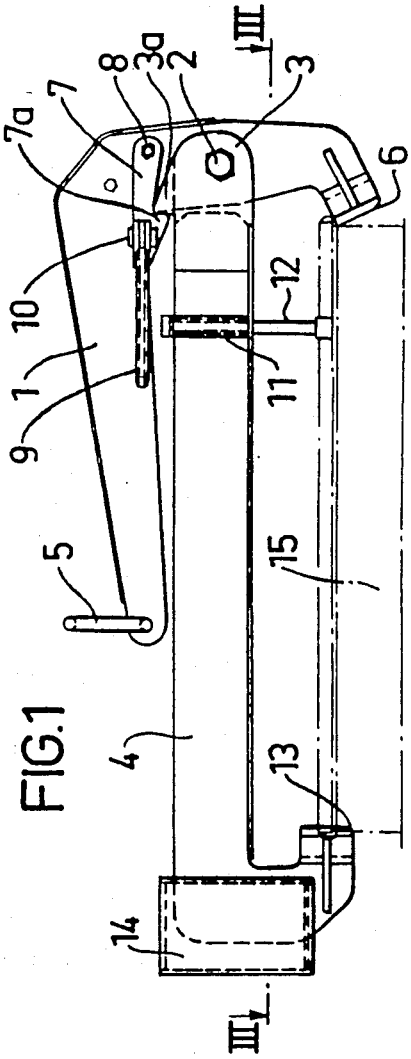

The barrel lifting device shown in FIGS. 1 and 2 comprises an L-shaped lifting arm 1 which is pivotably connected via a joint 2 to an ear 3 of a yoke 4. The lifting arm 1 is pivotable on the level of the paper in FIGS. 1 and 2.

At the free end of the stem of the arm there is arranged a lifting eye 5. A clamping shoe 6 is disposed at the free end of the base portion of the arm.

A locking arm 7 is arranged on the lifting arm 1 somewhat above the joint 2 via a joint 8. The locking arm 7 is pivotable on a level parallel to the pivotal plane of the lifting arm 1 and provided with a locking shoulder 7*a*.

A release means 9 is pivotably arranged via a joint 10 on the locking arm 7. The release means 9 is pivotable perpendicularly to the plane of the paper in FIGS. 1 and 2.

On the yoke 4 a sleeve 11 is adapted in which a pin 12 is movable in its longitudinal direction. The pin 12 coacts with the release means 9 in a way as will be described in detail below.

At its end facing away from the lifting arm 1 the yoke 4 has a fixed clamping shoe 13.

A counterweight container 14 is arranged at the end of the yoke 4 facing away from the lifting arm 1. Balancing of the barrel lifting device is carried out without a barrel and with the barrel lifting device in a position according to FIG. 1. Liquid lead is thereafter filled into the container 14 until the barrel lifting device enters a balance position.

Figure 3:
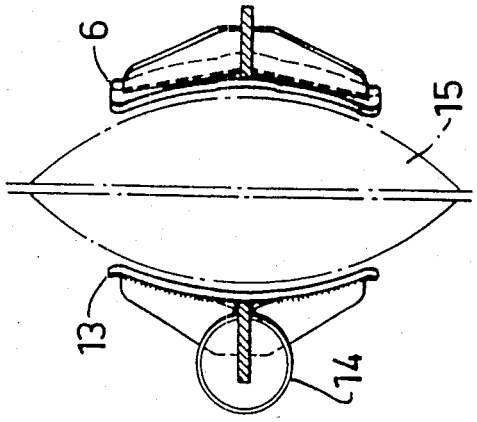
FIG. 3 shows a section taken on line III—III in FIG. 1.

In FIG. 3 the clamping shoes 6 and 13 are shown from above.

The contours of a barrel 15 are also drawn in FIGS. 1–3.

Using the barrel lifting device according to FIGS. 1–3 it is proceeded in the following way.

The barrel lifting device enters the position shown in FIG. 1, where it is lowered downwards towards the barrel 15. As shown in FIG. 1 the pin 12 will make contact with the upper side of the barrel. When the barrel lifting device is further lowered the pin 12 will be displaced upwards through the sleeve 11, the pin 12 displacing the release means 9 upwards. When this displacement of the release means 9 has proceeded so far that the shoulders 3*a* and 7*a* lose their engagement with each other, the lifting arm 1 will swing around the joint 2 and enter the position shown in FIG. 2. As is apparent from FIG. 2 the two clamping shoes 6 and 13 will then bear against the barrel 15. When a lifting force is applied in the lifting ear 5 a torque will actuate the lifting arm 1 so that it swings around the joint 2, the clamping shoe 6 being pressed against the barrel 15 which, in its turn, is pressed against the fixed clamping shoe 13. The clamping effect produced by the lifting arm 1 onto the barrel 15 is enough to lift the barrel 15 with a lifting force applied to the lifting eye 5.

After the barrel 15 is transferred to a desired place the barrel lifting device is to be released from the barrel 15.

In order that the barrel lifting device might release the barrel 15 the release means 9 must be placed in such a position that it is not influenced by the movable pin 12. In practice this means that the release means 9 is swung out from the lifting arm 1. When the pin 12 makes contact with the barrel 15 and is displaced upwards it will pass at the side of the release means 9 without displacing this.

At continued lowering of the lifting arm 1 towards the upper side of the barrel 15 the locking shoulder 7*a* will engage the locking shoulder 3*a*. The clamping shoe 13 will then be moved away from the barrel 15 and enter the position according to FIG. 1. The lifting arm 1 is now locked against pivoting around the joint 2, which means that if a lifting force is applied to the lifting eye 5 the whole barrel lifting device will be raised from the barrel 15.

By returning the release means 9 to active position, i.e. it will be swung towards the lifting arm, the barrel lifting means is ready to engage a new barrel to be lifted.

Figure 6:
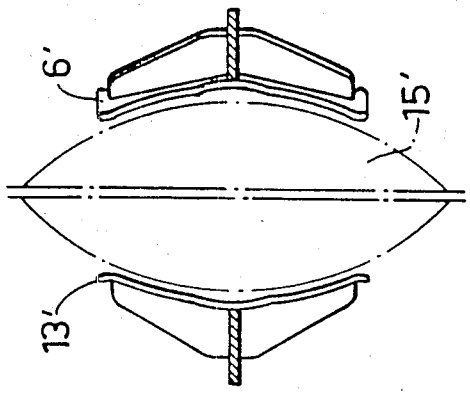
FIG. 5 is a lateral view of the device according to FIG. 4 in lifting position and FIG. 6 shows a section on the line VI—VI of FIG. 4.
Figure 5:
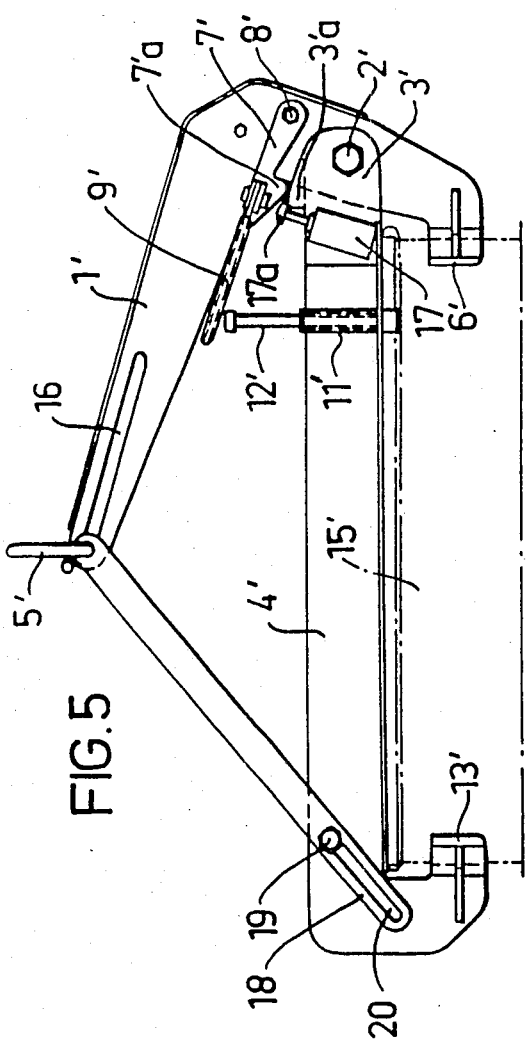
Figure 4:
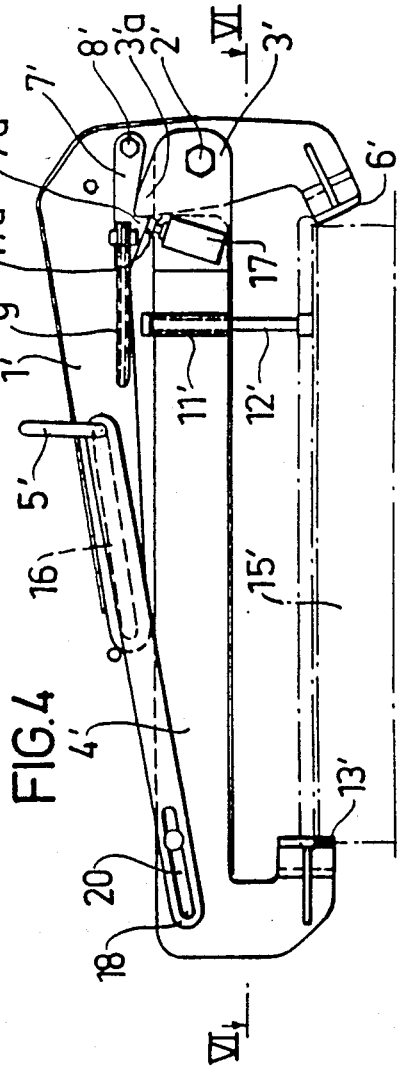
FIG. 4 is a lateral view of an alternative embodiment of the device of the invention, the device being in a position to engage the object to be lifted.

The embodiment shown in FIGS. 4–6 comprises an L-shaped lifting arm 1', which is pivotable via a joint 2' to an ear 3' of a yoke 4'. The lifting arm 1' is pivotable on the level of the paper.

In the stem of the arm a slot 16 is made which extends from the free end of the stem to about half the height of the stem. A lifting eye 5' is freely movable in the slot 16.

In a way corresponding to the embodiment according to FIGS. 1–3 there is arranged a locking arm 7' with a locking shoulder 7'a, which coacts with a locking shoulder 3'a of the ear 3'. A release means 9' operating in a way corresponding to the release means 9 is arranged on the locking arm 7'.

As in the embodiment according to FIGS. 1–3 a sleeve 11' is arranged on the yoke 4', a pin 12' being movably received in the sleeve 11'.

On the yoke 4' in connection with the ear 3' there is arranged a remote-controlled electromagnet 17 which shows a displaceable piston 17a. This electromagnet 17 can be activated from the driver's cab of the crane supporting the barrel lifting device.

Two stays or links 18, one on each side of the yoke 4', extend from the free end of the lifting arm 1 to a bolt 19 passing the yoke 4'. The links 18 are guided by the bolt 19 via slots 20.

At the end of the yoke 4' facing away from the lifting arm 1' a fixed clamping shoe 13' is mounted.

In this connection it should be pointed out that the embodiment according to FIGS. 4–6 is lacking a counterweight.

The embodiment according to FIGS. 4–6 operates in the following way.

When the barrel lifting device is to be applied it is in the position according to FIG. 4, i.e. the lifting arm 1 is locked against pivoting around the joint 2'.

When lowering the barrel lifting device towards the barrel 15' the pin 12' will make contact with the upper side of the barrel 15' and be displaced upwards through the sleeve 11' at further lowering of the barrel lifting device towards the barrel 15'. At said displacement of the pin 12' it will make contact with the release means 9' and displace this and the locking device 7' upwards. When the pin 12' has been displaced a predetermined way, the locking shoulders 3a and 7a will lose their engagement with each other, the lifting arm 1' swinging around the joint 2' to the position shown in FIG. 5. The clamping shoe 6' will then bear against the barrel 15'.

When the free end of the lifting arm 1' moves upwards the lifting eye 5' will be displaced in the slot 16 towards the centre of the barrel 15'. This displacement takes place automatically as the slot 16 is inclined upwards when the lifting arm 1' has entered the position according to FIG. 5. Thus, the lifting hook 5' will slide in the slot 16 when a lifting force is applied to the lifting hook 5'. When the lifting hook 5' has been displaced as far as the left end of the slot 16 in FIG. 5, lifting of the barrel 15' can be accomplished.

The embodiment according to FIGS. 4–6 also comprises an electromagnet 17 with a movable piston 17a. By activation of this electromagnet 17 which is made by means of remote control from the driver's cab, upward displacement of the locking means 7' can be achieved, the locking shoulders 3'a and 7'a losing their engagement with each other when the locking arm 7' has been displaced a predetermined way. This displacement of the locking arm 7' produced by the electromagnet 17 thus corresponds to the displacement of the release means 9' caused by the pin 12'. When it is desired to use the electromagnet 17 for release of the engagement of the locking shoulders 3'a and 7'a, the release means 9' is swung to inactive position, i.e. the pin 12' can pass at the side of the release means 9'.

After the electromagnet 17 has caused the engagement between the locking shoulders 3'a and 7'a to cease, the piston 17a is pushed into the electromagent 17 again.

When the barrel 15' has been moved to a desired place, the barrel lifting device is to be released from the barrel 15'. In order that this might be achieved it is required that the release means 9' is in inactive position.

The release of the barrel lifting device from the barrel 15' is carried out in such a way that when the barrel 15' rests against the support and further lowering of the lifting arm 1' takes place, the locking shoulder 7'a of the locking arm 7' will finally engage the locking shoulder 3'a. As the piston 17a is retracted and the release means 9' is in inactive position, these will not prevent the motion of the locking arm 7' to engagement with the locking shoulder 3'a. At the same time as the locking arm 7' moves to the position according to FIG. 4 the rulers 18 will displace the lifting hook 5' to the right in FIG. 4 to the end position shown in FIG. 4. Now the barrel lifting device can be lifted from the barrel 15' and is then in balance. In should be pointed out in this connection that the rulers 18 have no lifting function but they only guide the displacement of the lifting eye 5' in the slot 16.

The displacement of the lifting eye 5' described above will thus cause the barrel lifting device to be in balance at the position according to FIG. 4 without any counterweight being required.

Of course the barrel lifting device according to FIGS. 4–6 can be provided with merely one electromagnet 17 which is remote-controlled from the driver's stand for release of the latch, i.e. the release means 9', the sleeve 11' and the pin 12'. However, in practice it will be so that the barrel lifting device is manufactured in a standard design with pin and sleeve and release means. The electromagnet can be obtained an extra accessories.

Of course the invention is by no means restricted to the illustrative examples described above but can be freely varied within the scope of the appended claims.

I claim:

1. A device for lifting and handling objects, including cylindrical objects, comprising a lifting arm having a substantially vertical clamp portion and a substantially horizontal actuating portion provided with a lifting means, a yoke having a substantially vertical clamp portion having ends and a substantially horizontal portion, said clamp portion of the lifting arm being, between its ends, pivotally connected to a free end of the substantially horizontal portion of the yoke, clamping jaws mounted on the clamp portions of the lifting arm and the yoke for engagement with diametrically opposite sides of an object to be lifted, a locking mechanism for releasably locking said lifting arm to the yoke in open position and means for releasing said locking mechanism in downward swinging movement of the actuating portion of the lifting arm to allow the closing of the clamping jaws in order to grip the object to be lifted, said lifting means being arranged for free movement in a slot provided in the actuating portion of the lifting arm and being connected to one end of a link means, said link means having an opposite end portion pivotally connected to the yoke remote from that end thereof which is pivotally connected to the clamp portion of the lifting arm.

2. A device as in claim 1 wherein said opposite end portion of said link means is connected to said yoke by a bolt fixed to said yoke, said bolt being received in a longitudinal slot in said link means.

* * * * *